US009752311B2

(12) United States Patent
Davis et al.

(10) Patent No.: US 9,752,311 B2
(45) Date of Patent: Sep. 5, 2017

(54) ANTI-SIPHONIC TOILET

(71) Applicant: Kohler Co., Kohler, WI (US)

(72) Inventors: Robert S. Davis, Grafton, WI (US); Thomas M. Spankowski, Port Washington, WI (US); Lachlan A. Stewart, III, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 149 days.

(21) Appl. No.: 14/207,166

(22) Filed: Mar. 12, 2014

(65) Prior Publication Data

US 2014/0259350 A1 Sep. 18, 2014

Related U.S. Application Data

(60) Provisional application No. 61/779,944, filed on Mar. 13, 2013.

(51) Int. Cl.
*E03D 11/02* (2006.01)

(52) U.S. Cl.
CPC ..... *E03D 11/02* (2013.01)

(58) Field of Classification Search
CPC ..... E03D 11/02
See application file for complete search history.

(56) References Cited

U.S. PATENT DOCUMENTS 2,341,043 A * 2/1944 Hoffmann ..... E03D 11/02 4/421
2010/0313344 A1 12/2010 Ina et al.

FOREIGN PATENT DOCUMENTS

| | | |
|---|---|---|
| JP | H10-292890 A | 4/1998 |
| JP | 2001-207509 | 8/2001 |
| JP | 2006-112057 | 4/2006 |

OTHER PUBLICATIONS

European Search Report dated Jul. 18, 2014 regarding EP Application No. 14159631; 7 pages.

* cited by examiner

*Primary Examiner* — Janie Loeppke
(74) *Attorney, Agent, or Firm* — Foley & Lardner LLP

(57) ABSTRACT

A wash-down toilet including a bowl, a passageway, and a trapway. The bowl includes a sump. The passageway includes an inlet in fluid communication with the sump, an outlet provided at a height above the inlet, and a weir. The trapway includes an inlet, an outlet, and a vent, with the inlet of the trapway being in fluid communication with the outlet of the passageway and the outlet being in fluid communication with a soil pipe. The vent is configured to introduce a supply of air into the trapway during a flush cycle to prevent siphoning.

21 Claims, 10 Drawing Sheets

ANTI-SIPHONIC TOILET

CROSS-REFERENCE TO RELATED PATENT APPLICATIONS

This application claims the benefit of and priority to U.S. Provisional Patent Application No. 61/779,944, which was filed on Mar. 13, 2013. The foregoing U.S. provisional patent application is incorporated by reference herein in its entirety.

BACKGROUND

This application relates generally to the field of toilets. More specifically, this application relates to toilets including improved trapways configured to prevent a toilet, such as a wash-down toilet, from siphoning during its flush cycle.

Generally, toilets can be classified into two types based on the function of the flush cycle, with the first type being a siphonic toilet, and the second type being a wash-down toilet. In a siphonic toilet, an amount of water is quickly supplied during the flushing cycle to completely fill the trapway, which is typically S-shaped, with water. Air is removed from the trapway as it is filled with water, and a siphon is created, which rapidly evacuates any water and waste from the toilet bowl. The siphoning ends once the water level drops below the inlet of the passageway, thereby allowing air to be introduced. In a siphonic toilet, typically all of the water in the bowl is removed during the flush cycle, and therefore there is not enough water left in the bowl to act as a water barrier to block sewer gases (e.g., back flowing gases). Accordingly, after the siphon evacuates the bowl, water is added to the bowl to create a water barrier.

In a wash-down toilet, the trapway is generally not configured to induce a siphon. In a wash-down toilet, the water level in the toilet bowl is at equilibrium with the height of a weir or dam. When water is supplied to the toilet bowl during a flushing cycle, waste is carried out of the bowl by the excess water until the flush cycle is complete and equilibrium is reached. However, some wash-down toilets have a tendency for a siphon to occur during the flushing cycle. For example, if the water is introduced into the bowl too quickly, then a siphon can be induced in the trapway.

Furthermore, wash-down toilets generally are not configured to include a feature that refills the bowl after the flush cycle, since there is generally water left in the bowl following a flush cycle, unless siphoning has occurred. As a result, if siphoning occurs during the flush cycle of such a wash-down toilet, then more water may be pulled from the bowl of the toilet than may be desired.

Since adding a refill feature to wash-down toilets is relatively expensive and wastes water in the event there is no siphoning, there exists a need to prevent siphoning from occurring during the flush cycle in wash-down toilets without the addition of refill features.

SUMMARY

One embodiment relates to a wash-down toilet that includes a bowl, a passageway, and a trapway. The bowl includes a sump. The passageway includes an inlet in fluid communication with the sump, an outlet provided at a height above the inlet, and a weir. The trapway includes an inlet, an outlet, and a vent, with the inlet of the trapway being in fluid communication with the outlet of the passageway and the outlet being in fluid communication with a soil pipe. The vent is configured to introduce a supply of air into the trapway during a flush cycle to prevent siphoning.

The trapway may further include an elbow disposed between the inlet and the outlet of the trapway. The vent may be provided on an upper portion of the elbow. The vent, if provided on the upper portion of the elbow, may be located above a centerline of the inlet of the trapway.

The vent may be configured as a two-way vent, such that the vent is coupled to a transfer pipe configured to vent sewer gases from the toilet to the transfer pipe in addition to supplying air to the trapway. Alternatively, the vent may be configured as a one-way vent that prevents fluid from entering the vent. The one-way vent may include a valve that prevents the fluid from entering the vent.

The vent may have a cross-sectional size that is smaller than either a cross-sectional size of the inlet or a cross-sectional size of the outlet of the trapway. The cross-sectional size of the vent may be smaller than both the cross-sectional size of the inlet of the trapway and the cross-sectional size of the out of the trapway.

The inlet of the trapway may be coupled to the outlet of the passageway through a set of mating threads.

Another embodiment relates to a toilet configured to prevent siphoning during its flush cycle. The toilet includes a bowl having a sump, a passageway, and a trapway. The passageway includes an inlet that is in fluid communication with the sump, an outlet that is provided at a height above the inlet, and a weir that is provided at a height above the inlet between the inlet and outlet in the passageway. The trapway includes an inlet portion that is in fluid communication with the outlet of the passageway, an outlet portion configured to be in fluid communication with a soil pipe, and a vent tube that introduces a supply of air into the trapway at a location between the inlet portion and the outlet portion during a flush cycle to prevent siphoning. The vent tube is provided above a centerline of a vertical cross-section of the inlet portion of the trapway.

The vent tube may be configured having a cross-sectional area that is smaller than a cross-sectional area of an inlet of the inlet portion. The cross-sectional area of the vent tube may also be configured smaller than a cross-sectional area of an outlet of the outlet portion. The cross-sectional area of the outlet of the outlet portion may be configured smaller than the cross-sectional area of the inlet of the inlet portion.

The vent tube may be configured as a two-way vent that is coupled to a transfer pipe in order to vent sewer gases from the toilet (to the transfer pipe). The vent tube may be cylindrically shaped including a centerline, such that the vent tube extends between a first end coupled to the trapway and a second end, with the centerline of the first end of the vent tube located between a centerline of the outlet portion and the inlet of the inlet portion of the trapway (e.g., in a front-to-back direction of the trapway when cut by a vertical section). The first end of the vent tube may be coupled to a top side of an elbow portion, which interconnects the inlet portion and the outlet portion of the trapway.

Yet another embodiment relates to a method for flushing a wash-down toilet. The method includes introducing a supply of water into a bowl of the toilet to move water and waste in a sump of the bowl through a passageway to a trapway of the toilet, the passageway including an inlet and an outlet, wherein the outlet is provided at a height that is above the inlet and is in fluid communication with the trapway; introducing a supply of air into the trapway through a vent to prevent a siphon when the water and waste are flowing through the trapway; passing the water, waste, and air from the trapway; and providing a remaining volume of water in the sump.

The vent of the trapway may be provided above a centerline of a vertical cross-section of an inlet of the trapway, and the vent tube may have a cross-sectional area that is smaller than a cross-sectional area of the inlet of the trapway and a cross-sectional area of an outlet of the trapway.

The outlet of the trapway may be fluidly connected to a first pipe and the vent may be fluidly connected to a second pipe, wherein the vent is a two-way vent, such that gases are allowed to pass through the trapway and exit the vent into the second pipe. The water, waste, and air enter the first pipe through the outlet of the trapway.

DETAILED DESCRIPTION

Referring generally to the figures, disclosed herein are toilets, such as wash-down toilets, having improved trapways, which are configured to prevent or substantially reduce the likelihood of siphoning during the flush cycle of the toilet. The trapways may prevent siphoning by having a vent provided on an elbow of the trapway. The vent is configured to break the siphon by introducing air into the trapway, such as during the flush cycle. The vent may be provided on an upper portion of the elbow that is provided above the centerline of the entrance (e.g., inlet) of the trapway to prevent the back flow of water and waste into the vent. The vent may be configured to allow venting of gas (e.g., sewer gases) from the system through the vent.

Figure 1:
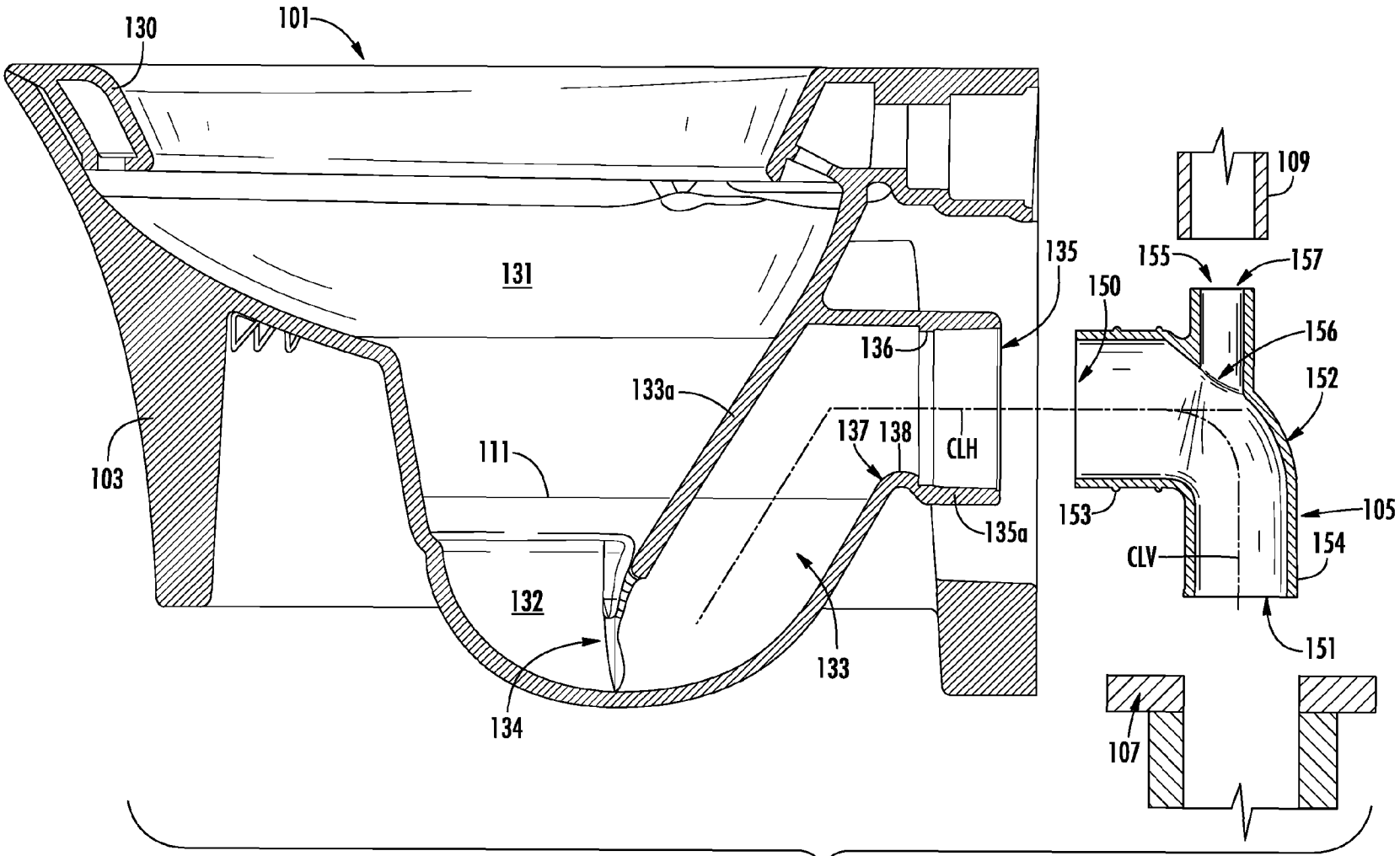
FIG. 1 is an exploded cross-sectional view of a toilet having a trapway coupled thereto, according to an exemplary embodiment.

FIG. 1 illustrates an exemplary embodiment of a toilet 101 configured as a wash-down toilet. As shown, the toilet 101 includes a pedestal 103, which may be composed of vitreous china or any other suitable material, and a trapway 105 (e.g., an external trapway) that is configured to be coupled to the pedestal 103 in fluid communication therewith in order to transfer water and waste from the pedestal 103 to a soil pipe 107 (e.g., drain pipe). In other words, the trapway 105 may be disposed between and in fluid communication with the pedestal 103 and the soil pipe 107. Although FIG. 1 illustrates a rear outlet toilet (e.g., a wall-mounted toilet), it is noted that the trapways disclosed herein may be used with other types of wash-down toilets, such as, for example, a floor outlet wash-down toilet.

As shown, the pedestal 103 includes a rim 130, a bowl 131 having a sump 132, and a passageway 133 (e.g., an internal trapway). The rim 130 is configured to extend around the bowl 131, and may introduce a supply of water into the bowl 131, such as during a flush cycle of the toilet 101. The supply of water may be introduced into the pedestal 103 through a valve from a tank, a water source, or any other suitable device that introduces water into the toilet. The bowl 131 may transition (e.g., narrow) into the sump 132 that is provided at the bottom of the bowl 131, and the sump 132 may be configured to hold a volume of water 111 in between flush cycles.

As shown in FIG. 1, the passageway 133 includes an inlet 134 and an outlet 135, where the inlet 134 is configured adjacent to and in fluid communication with the sump 132, and where the outlet 135 is configured adjacent to and in fluid communication with the trapway 105. Water and waste enter the inlet 134 of the passageway 133 from the sump 132 and exit the outlet 135 of the passageway 133 to pass into the trapway 105, which in turn transfers the water and waste to the soil pipe 107. As shown, the inlet 134 of the passageway 133 is disposed below the outlet 135 of the passageway 133, such that the passageway 133 includes an angled portion **133*a* (e.g., an upleg) that extends upward and rearward along an angle from the inlet 134 to the outlet 135 of the passageway 133. The outlet 135 of the passageway 133 may include a flange 135*a* that is configured to be coupled to the inlet of the trapway 105. For example, the flange 135*a* may include an inner diameter that is configured to receive the inlet of the trapway 105 to fluidly couple the passageway 133 and the trapway 105, such as through a threaded connection or other suitable connection. The outlet 135 and/or the flange 135*a* of the passageway 133 may be configured to extend in a generally horizontal direction, or may extend in a different direction, away from the angled portion 133*a* of the passageway 133. The base of the outlet 135 of the passageway 133 (i.e., where the flange 135*a* extends from) may be configured to include a shoulder 136, which may have a smaller size (e.g., diameter) relative to the size (e.g., inner diameter) of the outlet 135 of the passageway 133, such that the shoulder 136 may act as a stop to control how much of the trapway 105 (e.g., inlet of the trapway) can be inserted into the outlet 135 of the passageway 133. Thus, an end surface of the inlet of the trapway 105 may contact the shoulder 136 of the passageway 133 upon coupling the trapway 105 and passageway 133**.

Also shown in FIG. 1, the passageway 133 also includes a weir 137 (e.g., a dam) that is provided adjacent to the flange **135*a* and is configured to trap a volume of water 111 in the sump 132 and in a lower section of the angled portion 133*a* of the passageway 133. The volume of water 111 (as shown in FIG. 1 as the water provided below the water level) may form a seal to prevent or prohibit the back flow of gas (e.g., sewer gases) from the passageway 133 into the bowl 131. It is noted that the height of the water level may be different (e.g., lower, higher) than shown in FIG. 1, but the water level will be below an apex 138 of the weir 137. The weir 137 may be provided above the inlet 134 of the passageway 133 to form an airtight seal in the passageway 133, and may be the apex of the bottom of outlet 135 of the passageway 133 (e.g., the bottom wall as viewed relative to the centerline of the cross-section cut by a vertical plane, as shown in FIG. 1**) to trap water.

FIGS. 2-6 illustrate an exemplary embodiment of a trapway 105 for use in a toilet, such as the wash-down toilet 101, which is configured to prevent or substantially reduce the likelihood of siphoning during the flush cycle of the toilet 101. As shown, the trapway 105 includes an inlet 150 (e.g., entrance) and an outlet 151 (e.g., exit) provided at an opposite end of the trapway 105. The trapway 105 may also include an elbow 152 provided between the inlet 150 and the outlet 151. The trapway 105 may be made from a metal, such as iron (e.g., an iron pipe material) made through a casting process (e.g., cast iron), or may be made from other suitable materials, such as a plastic or polymer, or processes.

Figure 3:
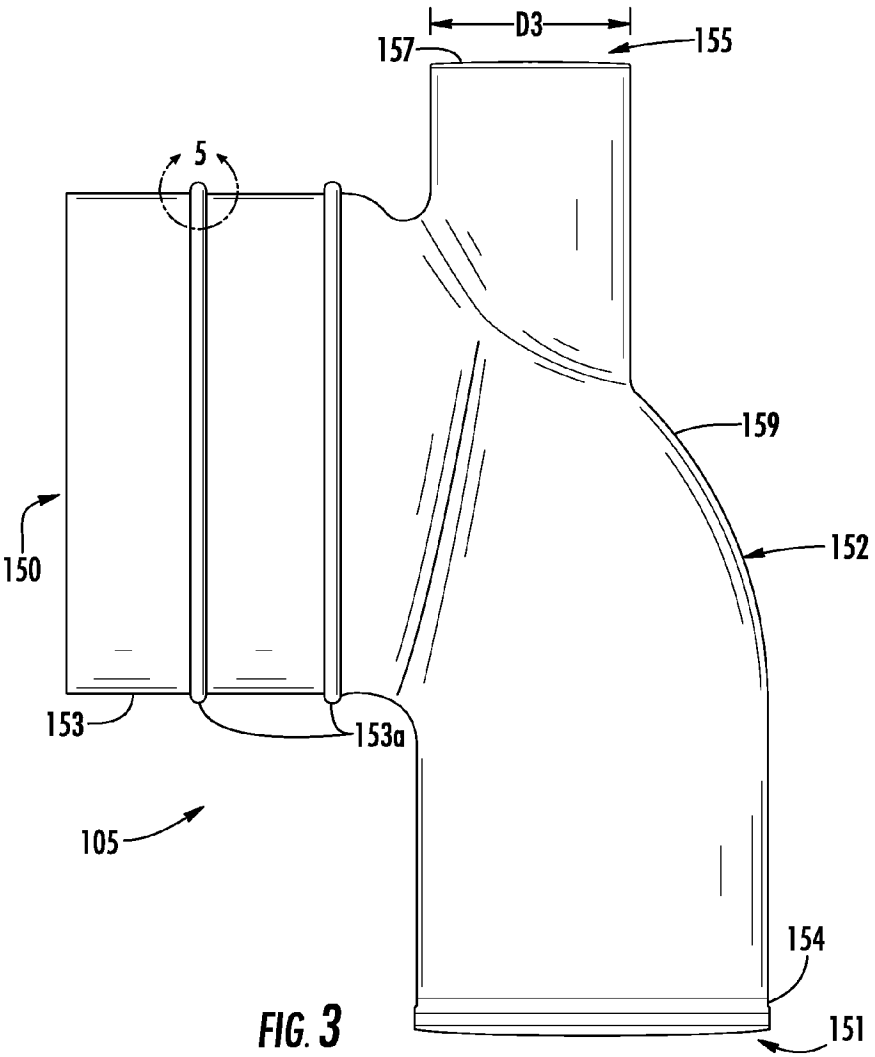
FIG. 3 is a side view of the trapway of FIG. 2.
Figure 2:
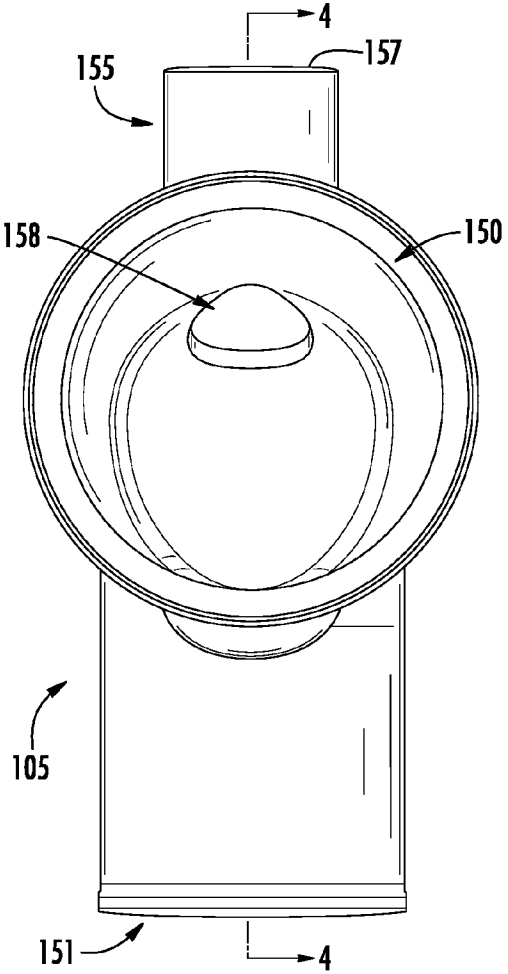
FIG. 2 is a front view of an exemplary embodiment of a trapway for use in a toilet, such as the toilet of FIG. 1.
Figure 5:
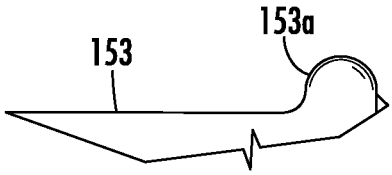
FIG. 5 is an enlarged view of the portion of the trapway of FIG. 3 shown in detail 5.

The inlet 150 of the trapway 105 is configured to be coupled to the outlet 135 of the passageway 133 and in fluid communication therewith. For example, the inlet 150 of the trapway 105 may have an outer surface 153 that is configured to be connected to the outlet 135 of the passageway 133 either directly or indirectly through one or more connecting members. Alternatively, the inlet 150 of the trapway 105 may have an inner surface that is configured to be connected to the outlet 135 of the passageway 133. The inner or outer surface 153 of the inlet 150 of the trapway 105 may include one or more than one annular ribs, threads having helical shapes, or another feature for fluidly connecting the inlet 150 of the trapway 105 to the passageway 133. As shown in FIG. 3, the outer surface 153 of the trapway 105 at the inlet 150 includes a plurality of ribs 153*a* that extend concentrically around the trapway in a parallel and spaced apart manner. As shown in FIG. 5, each rib 153*a* extends away from the outer surface 153 by a distance and includes a curved surface. The distance that each rib 153*a* extends away from the outer surface 153 may be tailored to influence, for example, the coupling strength between the trapway 105 and the pedestal 103.

The outlet 151 of the trapway 105 is configured to be coupled to the soil pipe 107 and in fluid communication therewith. For example, the outlet 151 of the trapway 105 may have an outer surface 154 that is configured to be connected to the soil pipe 107 either directly or indirectly through one or more connecting members. Alternatively, the outlet 151 of the trapway 105 may have an inner surface that is configured to be connected to the soil pipe 107. The inner or outer surface 154 of the outlet 151 of the trapway 105 may include one or more than one annular ribs, threads, or another suitable feature for connecting the outlet 151 of the trapway 105 to the soil pipe 107.

The inlet 150 of the trapway 105 may be configured having a larger size (e.g. diameter, cross-section, etc.) relative to the size of the outlet 151 of the trapway 105 and/or the outlet 135 of the passageway 133. According to an exemplary embodiment, an outer diameter D1 of the inlet 150 of the trapway 105 is 4.6-5.0 inches. More preferably, the outer diameter D1 of the inlet 150 is about 4.8 inches. According to an exemplary embodiment, the outer diameter D2 of the outlet 151 of the trapway 105 is 3.15-3.55 inches. More preferably, the outer diameter D2 of the outlet 151 is about 3.35 inches. According to an exemplary embodiment, the trapway 105 may have a wall thickness of about 0.29 inches (e.g., 0.29 inches±0.03 inches). Thus, the inlet 150 may have an inner diameter that is 4.02-4.42 inches, and the outlet 151 may have an inner diameter that is 2.57-2.97 inches. More preferably the inner diameter of the inlet 150 may be about 4.22 inches, and the inner diameter of the outlet 151 may be about 2.77 inches. This change in diameter of the trapway 105 from the inlet 150 to the outlet 151 may help to improve the flow of water and waste through the trapway 105, such as by increasing the velocity of the flow of waste.

Figure 4:
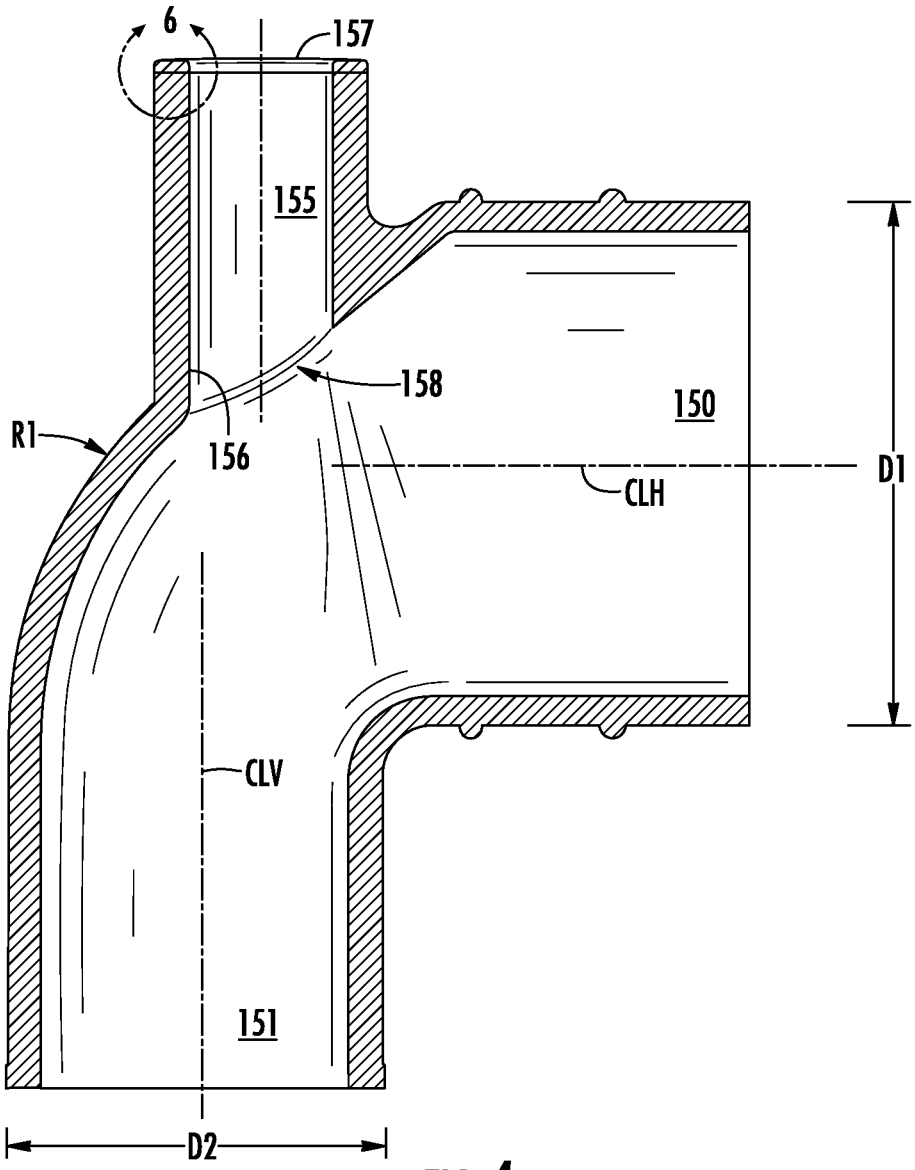
FIG. 4 is a cross-sectional view of the trapway of FIG. 2, taken along line 4-4 of FIG. 2.

The elbow 152 of the trapway 105, if provided, is located between the inlet 150 and outlet 151 of the trapway 105 and is configured to change the direction of the trapway 105 to redirect the flow of water and waste in the system. As shown in FIGS. 3 and 4, the elbow 152 is configured having a curved portion that transitions from a generally horizontal direction at the inlet 150 to a generally vertical direction at the outlet 151. The curved portion of the elbow 152 may be formed by a radius. According to an exemplary embodiment, the radius R1 of the elbow 152 is 2.0-2.4 inches. More preferably, radius R1 of the elbow 152 is about 2.2 inches. According to an exemplary embodiment, the elbow 152 extends for about 90° (ninety degrees), such as between its ends. In other words, the elbow 152 may be a 90° part. Alternatively, the curved portion may be formed by a curvature or other suitable shape, which may extend for more or less than 90°.

The trapway 105 also includes a vent 155 extending away from the trapway 105, such as in an upward direction. According to an exemplary embodiment, the vent 155 is configured to act as a two-way exchange for air and gas, where the vent 155 is configured to introduce a supply of air into the trapway 105 to prevent or prohibit siphoning during a flush cycle, and where the vent 155 is also configured to allow gases (e.g., sewer gases emitted) to travel into the trapway 105 and out through the vent 155. For example, the supply of air may be introduced into the flow of waste through the vent 155 when the waste and water pass through the trapway 105 to prevent siphoning by introducing air (e.g., a pocket of air) into the flow of water and waste. The vent 155 is not configured to pull air out of the system, such as the flow of waste during the flush cycle, because doing so would have the tendency to induce siphoning, and the vent 155 here is configured to prevent the siphoning. The vent 155 may be configured to pull air out of the system after the water and waste pass by the vent 155, such as to vent gases at the end of the flush cycle.

According to another exemplary embodiment, the vent 155 may be configured to act as a one-way exchange for air and/or fluid. For example, the vent 155 may include a valve or other suitable restricting feature to limit the flow of air (e.g., gas) and/or fluid in one direction. Thus, the valve may be configured to allow air to pass from the vent 155 into the trapway 105 to prevent siphoning, but may be configured to prevent the flow of air and/or fluid from the trapway 105 into the vent 155. For example, air may be introduced into the vent 155 via the pipe 109, which may be coupled at the other end to another device, which may influence (e.g., move) and/or generate the air supplied to the vent 155.

Figure 13:
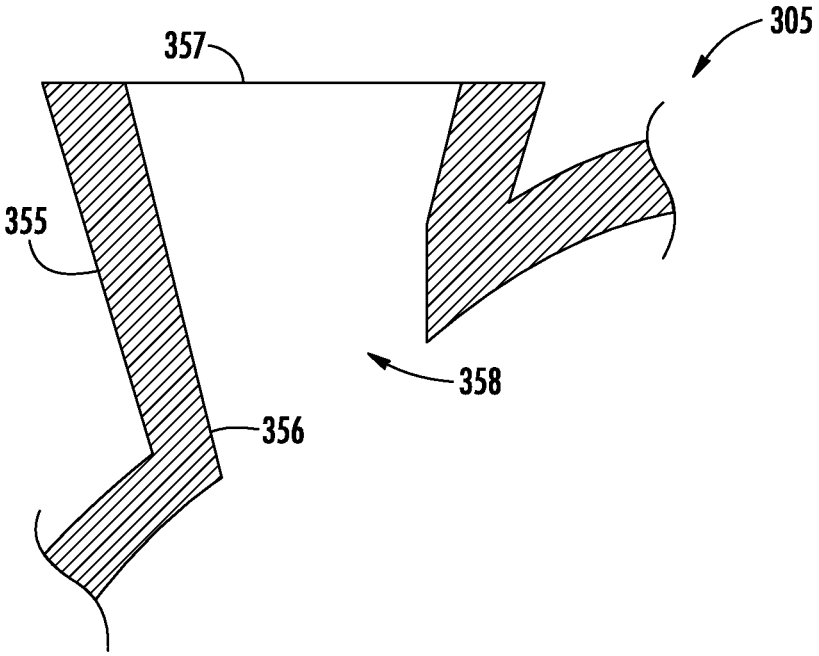
FIG. 13 is a detail view of a portion of another exemplary embodiment of a trapway.
Figure 14:
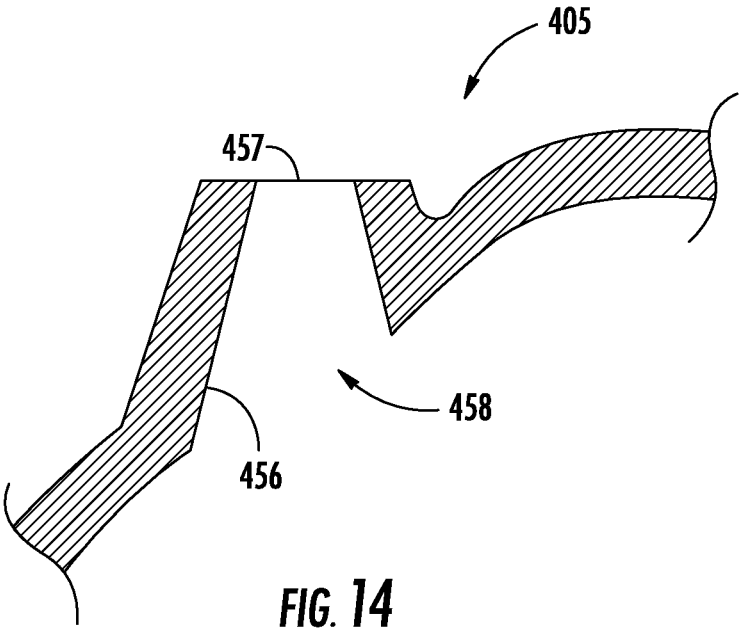
FIG. 14 is a detail view of a portion of another exemplary embodiment of a trapway.

As shown in FIG. 1, the vent 155 is configured as a tube (e.g., pipe, etc.) including a first end 156 and a second end 157. The vent 155 configured as a tube may have uniform inner and outer diameters, such that its size remains generally constant from the first end 156 to the second end 157. Alternatively, the vent 155 may be configured as a tube that varies in size, either increasing or decreasing in size as it moves from the first end 156 to the second end 157. FIG. 13 illustrates a vent 355 of the trapway 305 that has a decreasing tapered cross-section moving from its second end 357 to its first end 356. FIG. 14 illustrates a vent 455 of the trapway 405 that has a decreasing tapered cross-section moving from its first end 456 to its second end 457. The vent 155 may also have an outer diameter D3 that is smaller than the outer diameters D1, D2 of the inlet 150 and the outlet 151 of the trapway 105. According to an exemplary embodiment, the outer diameter D3 of the vent 155 is between 1-2 inches. More preferably, the outer diameter D3 of the vent 155 is about 1.9 inches, which is smaller than the diameter of the outlet 151 of the trapway 105, yet is of adequate size to sufficiently allow an adequate supply of air/gas exchange therethrough.

Figure 6:
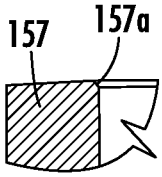
FIG. 6 is an enlarged view of the portion of the trapway of FIG. 4 shown in detail 6.
Figure 7:
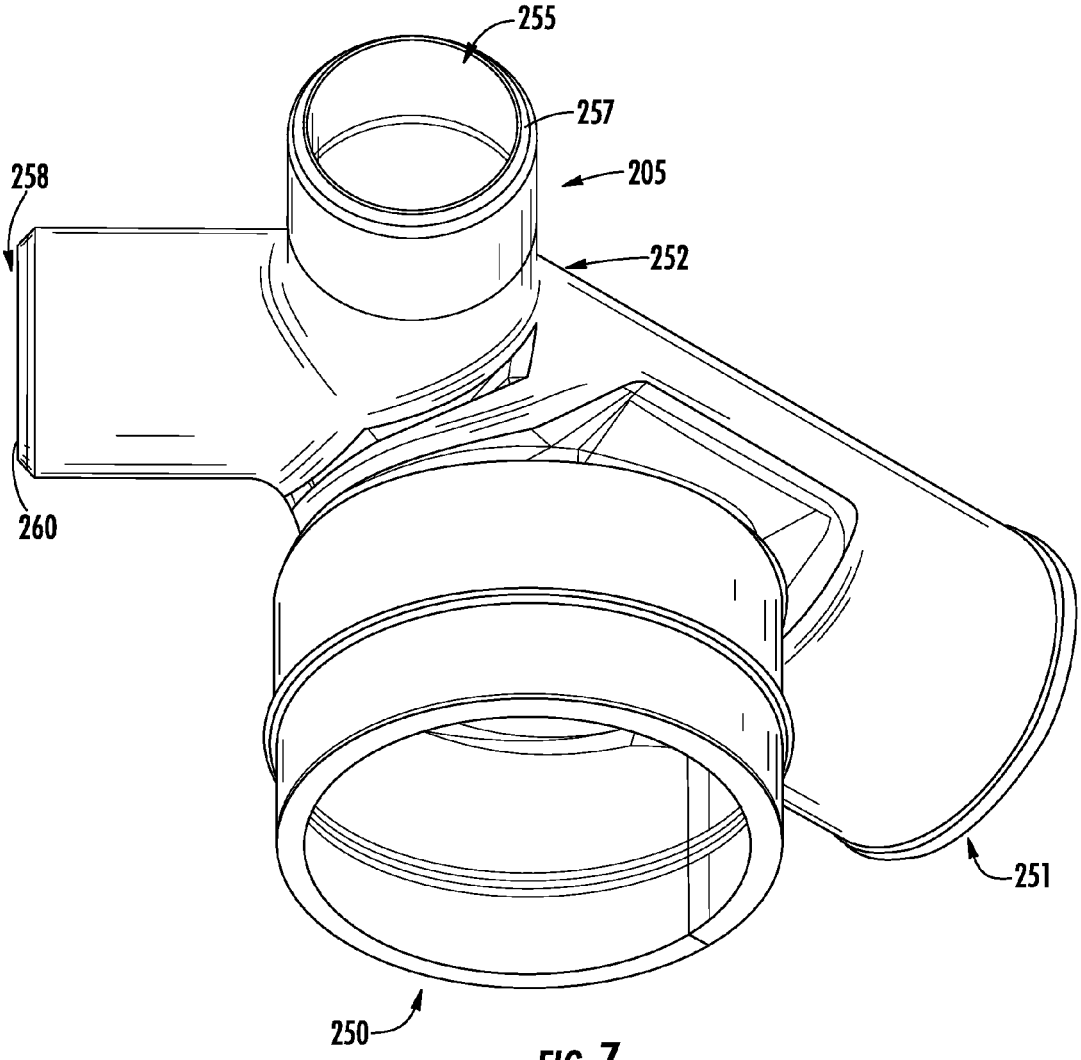
FIG. 7 is a perspective view of another exemplary embodiment of a trapway for use in a toilet, such as the toilet of FIG. 1.

The first end 156 of the vent 155 is located along the trapway 105, such as at an opening 158 in the elbow 152 of the trapway 105. The second end 157 of the vent 155 is distally located relative to the first end 156 and may be configured to connect to another component. For example, the second end 157 may be configured to connect (e.g., fluidly connect) to another pipe 109, which may be configured to transfer gases (e.g., sewer gases) out of the toilet 101, such as for the two-way vent configuration. The pipe 109 connected to the second end 157 may be configured to transfer the vented gases out of the building in which the toilet 101 is installed. The second end 157 may include a feature that is configured to facilitate coupling the pipe to the vent 155. As an example, FIG. 6 illustrates a chamfer 157*a* on the inner edge of the second end 157 of the vent 155, which may help facilitate a pipe that couples to the inner surface (e.g., inner diameter) of the second end 157. According to other examples, the feature may be a chamfer on the outer edge of the second end 157, or may be configured differently than a chamfer (e.g., a fillet, threads, ribs, etc.).

As shown, the vent 155 is configured as a generally straight tube. However, the shape of the vent 155 may be different than shown. For example, the vent 155 may be curved or may have any other suitable shape that allows air to be introduced into the elbow 152 of the trapway 105 to prevent siphoning during a flush cycle of the toilet 101.

The vent 155 may be provided on an upper surface 159 (e.g., relative to the centerline of the inlet portion of the trapway when viewed in cross-section by a vertical cutting plane) of the elbow 152 of the trapway 105 rearward (e.g., downstream) of the inlet 150 of the trapway 105. As shown in FIG. 4, the vent 155 is located on the upper surface of the elbow 152 at a location that is provided above a centerline CLH of the inlet 150 of the trapway 105. This location of the vent 155 may advantageously prevent the flow of water and waste from entering the vent 155 and passing up through the vent 155, while allowing air to pass through the vent 155 and into the trapway 105, such as to break siphoning, even if a valve is not provided.

It is noted that the trapway 105 shown is a separate member that is made separately from the pedestal 103, then coupled to the pedestal 103 (e.g., vitreous pedestal), because it would be difficult to manufacture the trapway 105 as configured, such as including the vent 155, without becoming relatively expensive. Moreover, a trapway 105 integrally formed with the vitreous may be difficult to attach (e.g., connect, couple, etc.) other features thereto, such as another feature which connects to the vent 155 of the trapway 105. Thus, although the trapways, as disclosed herein, may be integrally formed with the vitreous, it would be advantageous for at least the above reasons to form the trapway 105 and pedestal 103 separately.

The toilet 101 may include a seal that is configured to seal the system (e.g., the trapway 105). For example, the toilet 101 may include a first seal that is provided between the outlet 135 of the pedestal 103 and the inlet 150 of the trapway 105 that seals the connection therebetween. Also, for example, the toilet 101 may include a second seal that is provided between the outlet 151 of the trapway 105 and the soil pipe 107 (or other element coupled thereto) to seal the connection therebetween. Also, for example, the toilet 101 may include a third seal that is configured to seal the connection between the vent 155 and the element coupled thereto, if any such element is provided. Each seal may be configured to prevent leaking of fluid and/or air from the connection, and may be configured using any suitable sealing material having any suitable shape.

FIGS. 7-12 illustrate another exemplary embodiment of a trapway 205 for use with a toilet, such as the wash-down toilet 101. As shown, the trapway 205 includes a body portion having an inlet 250 (e.g., entrance) and an outlet 251 (e.g., exit) provided at an opposite end of the trapway 205. The body portion of the trapway 205 may also include an elbow 252 provided between the inlet 150 and the outlet 151. The inlet 250 of the trapway 205 is configured to be coupled to an outlet (e.g., the outlet 135) of a passageway of a toilet to be in fluid communication with the passageway. The outlet 251 of the trapway 205 is configured to be coupled to the soil pipe 207 to be in fluid communication with the soil pipe 207. The elbow 252 of the trapway 205, if provided between the inlet 250 and outlet 251, is configured to change the direction of the trapway 205 to redirect the flow of water and waste in the system. As shown, the elbow 252 is configured having a curved portion that transitions from a generally horizontal direction at the inlet 250 to a generally vertical direction at the outlet 251. In other words, the elbow 252 may extend over an angular travel of about 90° (ninety degrees).

The trapway 205 may also include a vent that extends away from the body portion of the trapway 205, such as in an upward direction. As shown in FIGS. 7-12, the trapway 205 includes a first vent 255 and a second vent 258. The first vent 255 and second vent 258 may extend adjacent to one another and away from the body portion, such as from an upper surface (e.g., section, portion, etc.) of the body portion. Each vent 255, 258 may be provided on an upper surface (e.g., when viewed in cross-section by a vertical cutting plane), such as an upper surface of the elbow 252, that is rearward (e.g., downstream) of the inlet 250 and above a centerline of the inlet 250 to advantageously prevent the flow of water and waste from entering each vent 255, 258.

Figure 8:
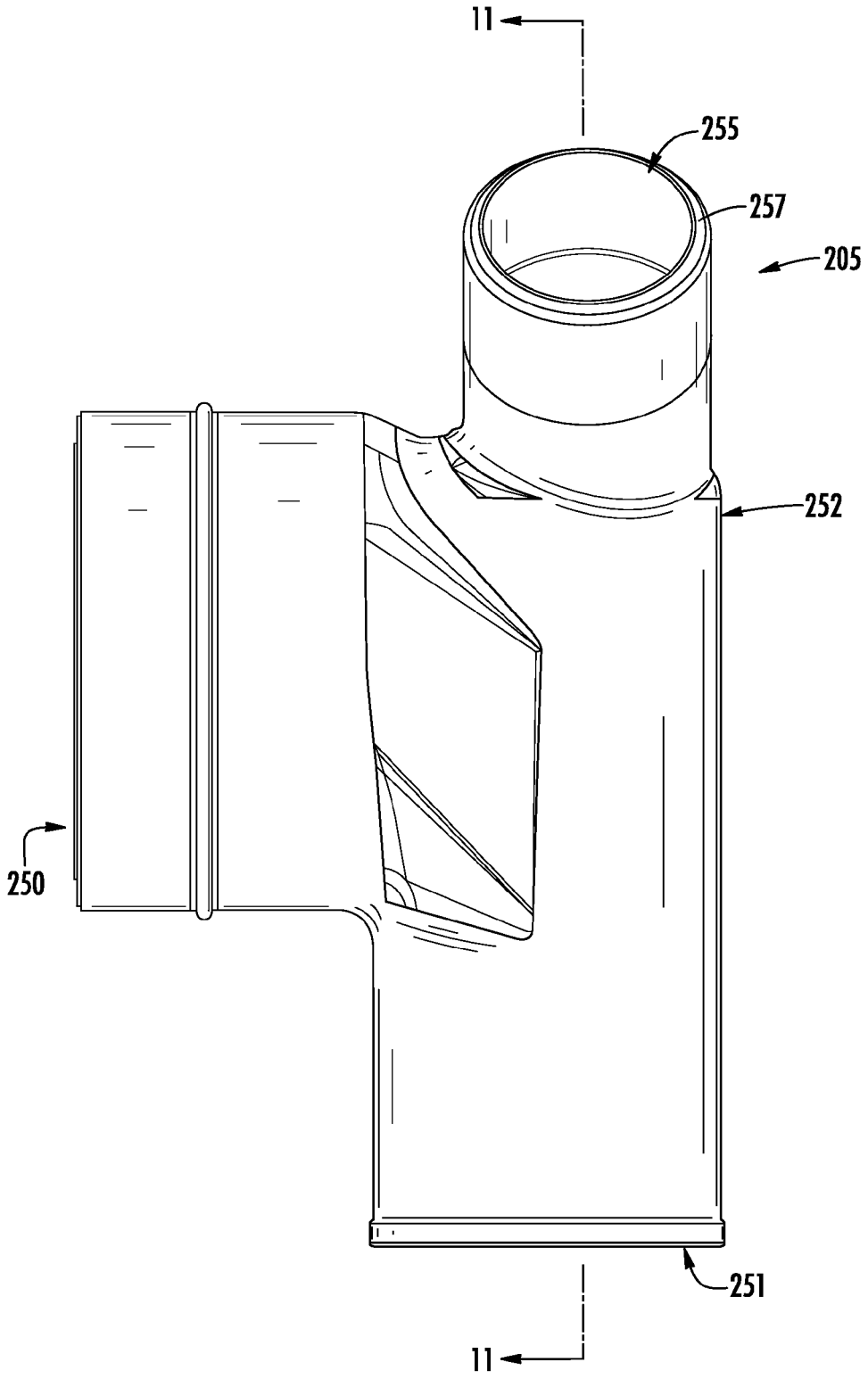
FIG. 8 is a side view of the trapway of FIG. 7.

As shown in FIG. 8, the first vent 255 and second vent 258 are configured at an angle A1 relative to one another when viewed from the front of the trapway 205. According to one example, each of the first vent 255 and the second vent 258 is configured at an angle A2 relative to vertical, such that the vents extend away from the body portion in a symmetric manner from a vertical plane. The first and second vents 255, 258 may extend radially away from the centerline of the inlet 250 of the body portion at the angle A2. Thus, the first and second vents 255, 258 may have a generally V-shape.

Figure 9:
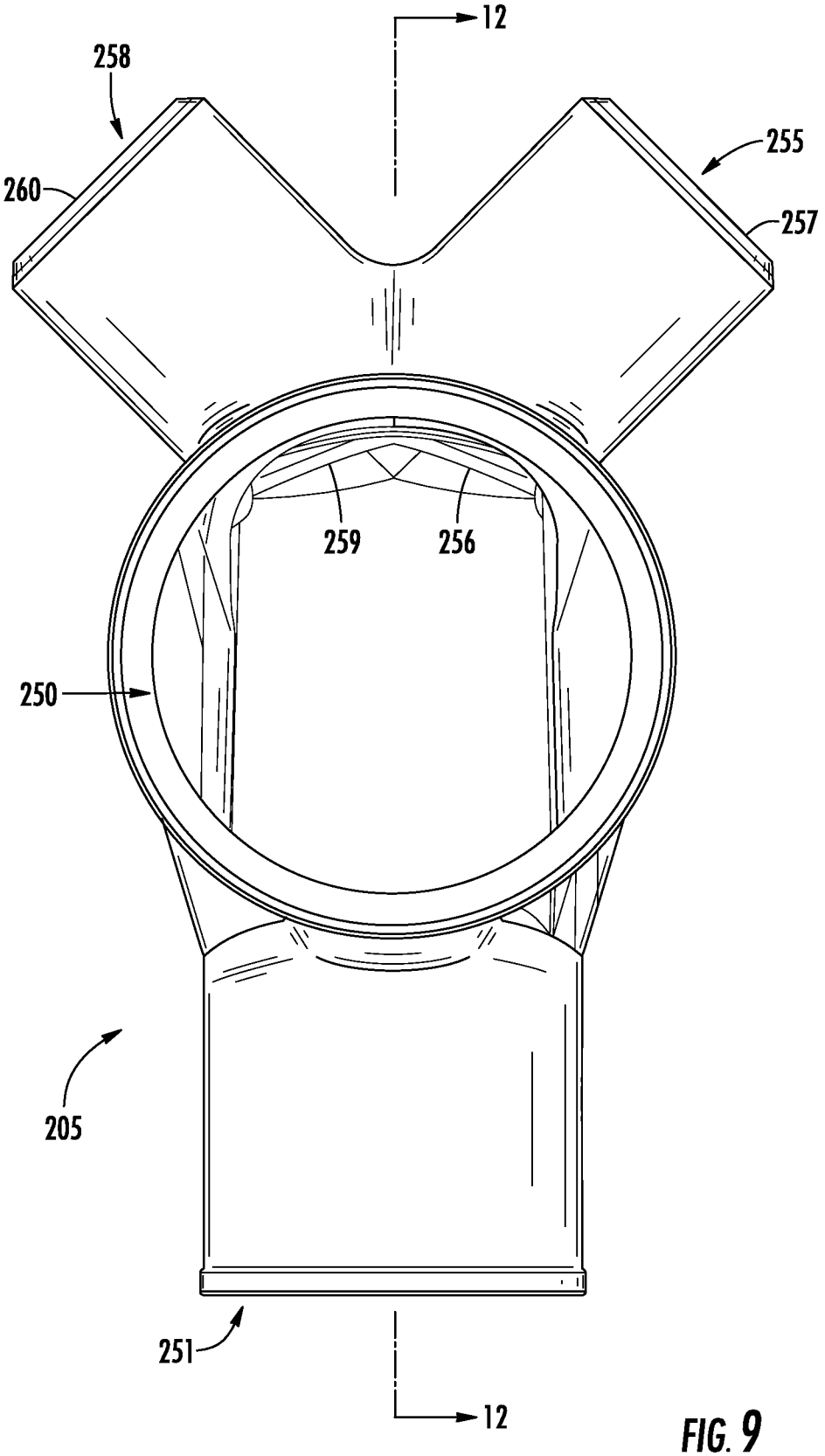
FIG. 9 is a front view of the trapway of FIG. 7.
Figure 10:
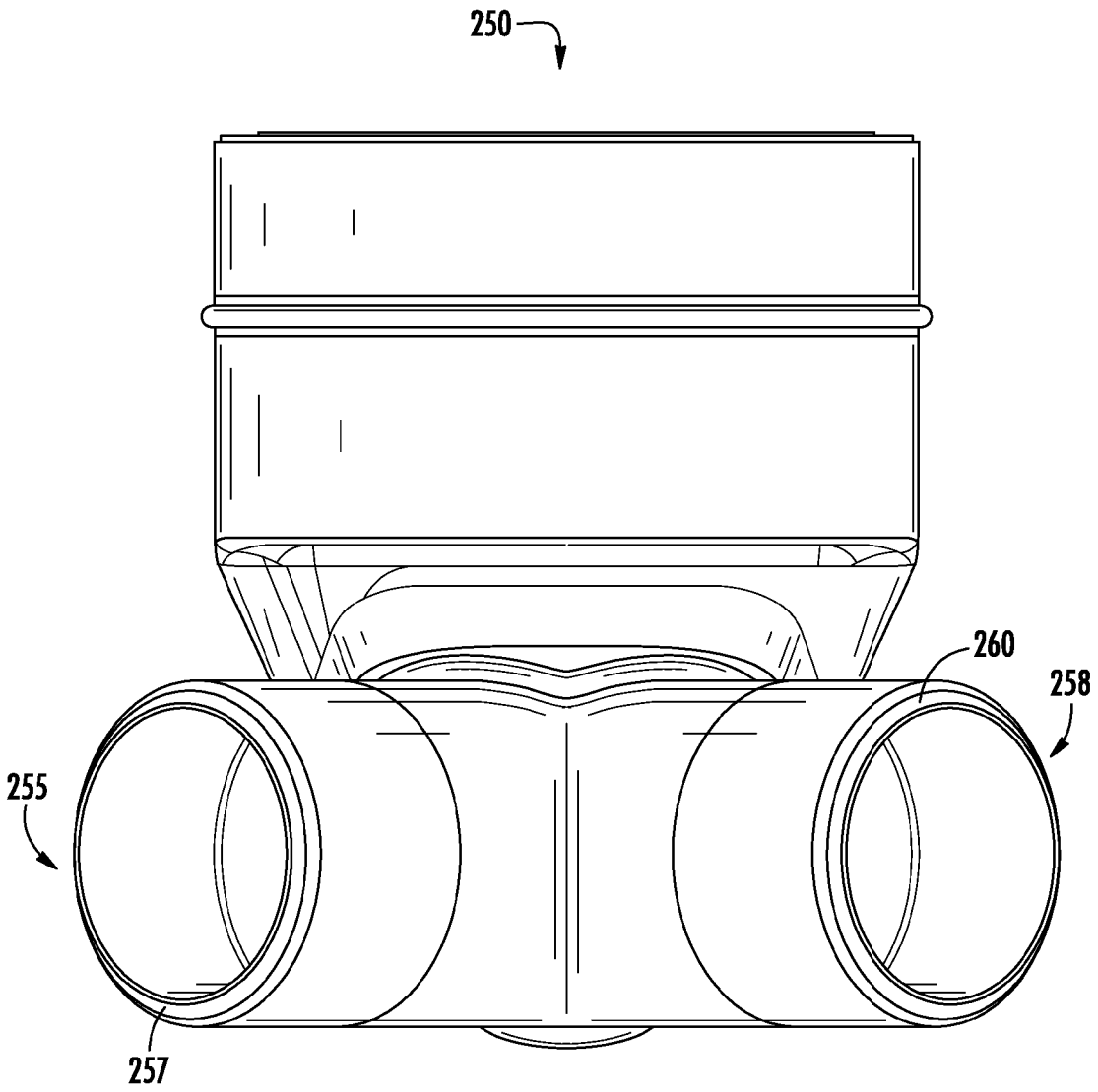
FIG. 10 is a top view of the trapway of FIG. 7.

As shown in FIG. 9, the first vent 255 includes a first end 256 and a second end 257. The first end 256 of the first vent 255 is located along the trapway 205, such as at an opening in the body portion. For example, the first end 256 of the first vent 255 may be coupled to the body portion of the trapway 205, such as the upper surface of the elbow 252, to place the first vent 255 and the body portion of the trapway 205 in fluid communication. The second end 257 of the first vent 255 is distally located relative to the first end 256 and may be configured to connect to another component. The second end 257 of the first vent 255 may be closed-off or may be open-ended. For example, the second end 257 may include a cap to form a closed second end, such as to prevent flow from the second end 257. Also, for example, the second end 257 may be open-ended and in fluid communication with another element or object, such as a pipe to input a supply of air into the first vent 255 and/or output gases (e.g., sewer gases) from the toilet to the pipe.

Also shown in FIG. 9, the second vent 258 includes a first end 259 and a second end 260. The first end 259 of the second vent 258 is located along the trapway 205, such as at an opening in the body portion. For example, the first end 259 of the second vent 258 may be coupled to the body portion of the trapway 205, such as the upper surface of the elbow 252. The second end 260 of the second vent 258 is distally located relative to the first end 259 and may be configured to connect to another component. The second end 260 of the second vent 258 may be closed-ended (e.g., closed-off) or may be open-ended (e.g., opened). For example, the second end 260 may include a cap to form a closed second end, such as to prevent flow from the second end 260. Also, for example, the second end 260 may be open-ended and in fluid communication with another element or object, such as a pipe to input a supply of air into the second vent 258 and/or output gases (e.g., sewer gases) from the toilet to the pipe.

Each vent 255, 258 may be configured as a tube, a pipe, or any suitable shape that is capable of transferring a fluid to and from trapway 205. Each vent 255, 258 may be configured, for example, as a generally straight tube, a curved tube, or may have any other suitable shape that allows a fluid to be transferred through the vent.

Each vent 255, 258 may have uniform cross-sectional shape, such as where its inner and outer sizes (e.g., diameters) remain generally constant from its first end 256, 259 to its second end 257, 260. Alternatively, each vent 255, 258 may vary in size, either increasing or decreasing in size as it moves from its first end 256, 259 to its second end 257, 260. For example, each vent 255, 258 may have an increasing or decreasing diameter moving from one end to the other end. Also, for example, one of the vents 255, 258, such as a one-way vent that introduces air into the body portion of the trapway 205, may have a decreasing size from its second end to its first end, which may increase the flow (e.g., velocity) of the air moving through the vent; and the other of the vents 255, 258, such as a one-way vent that transfers gases from the body portion to the vent, may have a decreasing size from its first end to its second end, which may increase the flow (e.g., velocity) of the gases moving through the vent.

Figure 11:
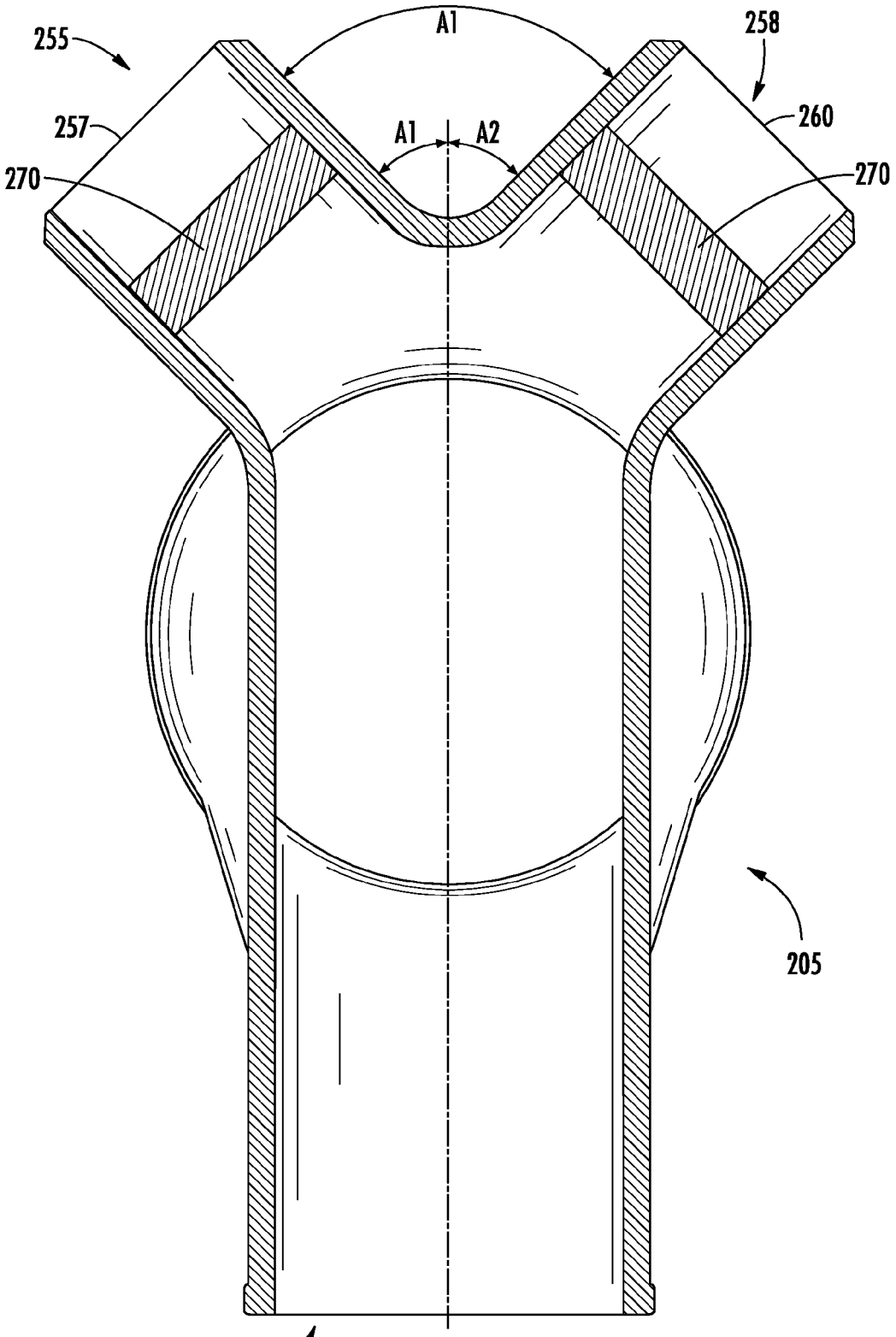
FIG. 11 is a cross-sectional view of the trapway of FIG. 7, taken along line 11-11 of FIG. 8.
Figure 12:
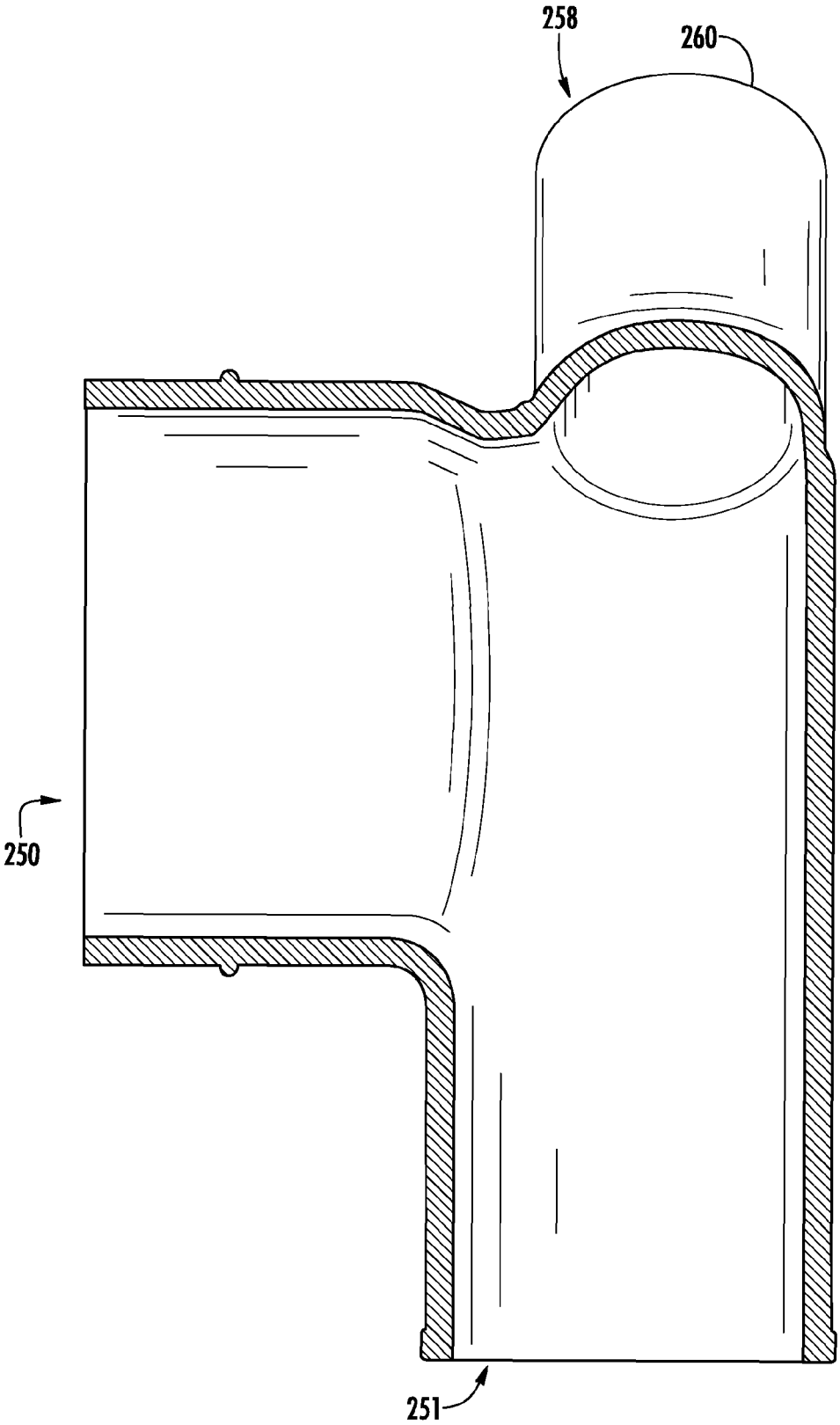
FIG. 12 is a cross-sectional view of the trapway of FIG. 7, taken along line 12-12 of FIG. 9.

Each vent of the first and second vents 255, 258 may be configured to be closed-ended or may be open-ended, either in a one-way configuration or in a two-way configuration. The one-way configured vent allows an exchange of fluid (e.g., air, gases, etc.) in only a single direction. For example, the one-way vent may be configured to allow a fluid, such as air, to exit the vent into the body portion of the trapway 205, but prevents any fluid from entering the vent from the body portion. Also, for example, the one-way vent may be configured to allow fluid, such as gases, to enter the vent from the body portion of the trapway 205, but prevents any fluid from exiting the vent into the body portion. Each one-way vent may include a valve or other suitable restricting feature to limit the flow of fluid in one direction relative to the vent. FIG. 11 is illustrated to include a valve 270 provided in each of the vents 255, 258. However, as disclosed herein, each vent 255, 258 may be configured without a valve, or a valve 270 may be provided in one of the vents 255, 258.

The two-way configured vent allows an exchange of fluid in at least two directions. In other words, the two-way vent is configured to allow fluid to both exit the vent (e.g., the vent 255, the vent 258) into the body portion of the trapway 205 and enter the vent from the body portion. For example, the two-way vent may be configured to allow air to enter the body portion of the trapway 205 from the vent, such as during a flush cycle to prevent siphoning, and may further allow gases to exit the body portion and enter the vent, such as to transfer the gases from the toilet at the end of a flush.

According to an exemplary embodiment, one of the first and second vents 255, 258 is configured as a one-way vent that allows fluid, such as air, to enter the body portion of the trapway 205 from the vent, and the other vent is configured as a one-way vent that allows gases to exit the body portion into the other vent. Each of the first and second vents 255, 258 may include a valve, which may be configured to open/close depending on the operation of the toilet. For example, the valve in the vent (e.g., the first vent 255) that introduces air into the body portion from the vent may be timed to open during the flush cycle when the water and waste flow through the body portion to introduce a supply of air (e.g., a pocket of air) into the body portion to prevent siphoning of the toilet. Also, for example, the valve in the vent (e.g., the second vent 258) that escapes sewer gases from the body portion to the vent may be timed to be closed during the flush cycle when the water and waste flow through the body portion and may be open before and after the period of the flush cycle when the water and waste flow through the body portion of the trapway 205.

According to another exemplary embodiment, one of the first and second vents 255, 258 is configured as a two-way vent that allows fluid to enter/exit the body portion of the trapway 205 from/to the vent, and the other vent may be closed-off. This arrangement may be advantageous where an obstacle (e.g., member, structure, element, component, etc.) is positioned above one of the vents, but not above the other vent, such that one of the vents may be utilized to vent around the obstacle. Thus, the two-vent trapway 205 may be configured to route the venting around another structure, and prevent siphoning of the toilet during its flush cycles.

According to another exemplary embodiment, both of the first and second vents 255, 258 may be configured as two-way vents. Thus, both of the first and second vents 255, 258 may be configured to allow fluid to enter the body portion of the trapway 205 from the vent and exit the body portion to the vent.

It is noted that although specific dimensions have been provided for various features and elements of the toilet, such as the trapway of the toilet, the dimensions provided are exemplary and are not limiting.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the toilets and trapways as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present invention. For example, any element provided in one embodiment may be used with any other embodiment of the application.

What is claimed is:

1. A wash-down toilet, comprising:

a bowl having a sump;

a passageway having an inlet, an outlet provided at a height above the inlet, and a weir, the inlet being in fluid communication with the sump;

a trapway having an inlet, an outlet, and a vent, the inlet of the trapway being in fluid communication with the outlet of the passageway, the outlet configured to be in fluid communication with a soil pipe; and a supply of air provided from an air supply to the trapway by way of the vent;

wherein the vent introduces the supply of air into the trapway during a flush cycle to prevent siphoning; and wherein the vent is configured as a one-way vent that prevents fluid from entering the vent from the trapway.

2. The wash-down toilet of claim 1, wherein the trapway further includes an elbow disposed between the inlet and the outlet of the trapway.

3. The wash-down toilet of claim 2, wherein the vent is provided on an upper portion of the elbow.

4. The wash-down toilet of claim 3, wherein the vent provided on the upper portion of the elbow is located above a centerline of the inlet of the trapway.

5. The wash-down toilet of claim 1, wherein the one-way vent includes a valve to prevent the fluid from entering the vent.

6. The wash-down toilet of claim 4, wherein the vent has a cross-sectional size that is smaller than either a cross-sectional size of the inlet or a cross-sectional size of the outlet of the trapway.

7. The wash-down toilet of claim 6, wherein the cross-sectional size of the vent is smaller than both the cross-sectional size of the inlet of the trapway and the cross-sectional size of the outlet of the trapway.

8. The wash-down toilet of claim 1, wherein the inlet of the trapway is coupled to the outlet of the passageway through a set of mating threads.

9. A toilet configured to prevent siphoning during its flush cycle, comprising:

a bowl having a sump;

a passageway having an inlet in fluid communication with the sump, an outlet provided at a height above the inlet, and a weir provided at a height above the inlet between the inlet and outlet in the passageway;

a trapway having an inlet portion in fluid communication with the outlet of the passageway, an outlet portion configured to be in fluid communication with a soil pipe, and a vent tube positioned between the inlet portion and the outlet portion the vent tube configured as a one-way vent that prevents fluid from entering the vent tube from the trapway; and a supply of air provided from an air supply to the trapway through the vent tube;

wherein the supply of air is fed to the trapway during a flush cycle to prevent siphoning; and wherein the vent tube is provided above a centerline of a vertical cross-section of the inlet portion of the trapway.

10. The toilet of claim 9, wherein the vent tube has a cross-sectional area that is smaller than a cross-sectional area of an inlet of the inlet portion of the trapway.

11. The toilet of claim 10, wherein the cross-sectional area of the vent tube is smaller than a cross-sectional area of an outlet of the outlet portion of the trapway.

12. The toilet of claim 11, wherein the cross-sectional area of the outlet of the outlet portion of the trapway is smaller than the cross-sectional area of the inlet of the inlet portion of the trapway.

13. The toilet of claim 9, wherein the vent tube is cylindrically shaped including a centerline, wherein the vent tube extends between a first end coupled to the trapway and a second end, wherein the centerline of the vent tube at the first end is located between a centerline of the outlet portion of the trapway and the inlet of the inlet portion of the trapway.

14. The toilet of claim 9, wherein a first end of the vent tube is coupled to a top side of an elbow portion interconnecting the inlet and outlet portions of the trapway.

15. A method for flushing a wash-down toilet, comprising:

introducing a supply of water into a bowl of the toilet to move water and waste in a sump of the bowl through a passageway to a trapway of the toilet, the passageway including an inlet and an outlet, wherein the outlet is provided at a height that is above the inlet and is in fluid communication with the trapway;

introducing a supply of air into the trapway through a vent to prevent a siphon when the water and waste flow through the trapway;

passing the water, waste, and air from the trapway; and providing a remaining volume of water in the sump.

16. The method of claim 15, wherein the vent of the trapway is provided above a centerline of a vertical cross-section of an inlet of the trapway, and wherein the vent tube has a cross-sectional area that is smaller than a cross-sectional area of the inlet of the trapway and a cross-sectional area of an outlet of the trapway.

17. The method of claim 16, wherein the outlet of the trapway is fluidly connected to a first pipe and the vent is fluidly connected to a second pipe.

18. The method of claim 15, wherein the vent is a two-way vent, such that gases are allowed to pass through the trapway and exit the vent into the second pipe, and wherein the water, waste, and air enter the first pipe through the outlet of the trapway.

19. The method of claim 18, wherein gases are not passed through the second pipe while the water, waste, and air are passing from the trapway.

20. The method of claim 15, wherein the vent is a one-way vent, such that the supply of air passes from the vent to the trapway, but gases do not pass from the trapway through the vent.

21. The method of claim 15, further comprising preventing gases from passing from the trapway through the vent.

* * * * *